US009335088B2

(12) United States Patent
Park et al.

(10) Patent No.: US 9,335,088 B2
(45) Date of Patent: May 10, 2016

(54) REFRIGERATOR INCLUDING A DISPENSER

(71) Applicant: LG Electronics Inc., Seoul (KR)

(72) Inventors: Kyutae Park, Seoul (KR); Kyungsoo Park, Seoul (KR); Seonkyu Kim, Seoul (KR); Hyokku Kwon, Seoul (KR); Hangbok Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 111 days.

(21) Appl. No.: 14/201,415

(22) Filed: Mar. 7, 2014

(65) Prior Publication Data

US 2014/0251498 A1 Sep. 11, 2014

(30) Foreign Application Priority Data

Mar. 8, 2013 (KR) ..... 10-2013-0025231

(51) Int. Cl.

| | |
|---|---|
| ***F25D 23/02*** | (2006.01) |
| ***B67D 1/08*** | (2006.01) |
| ***B67D 3/00*** | (2006.01) |
| ***F25D 23/12*** | (2006.01) |

(52) U.S. Cl.

CPC ..... *F25D 23/126* (2013.01)

(58) Field of Classification Search

CPC . F25D 2331/806; F25D 23/02; F25D 23/028; B67D 2210/00036; B67D 2210/00041; B67D 1/0857; B67D 3/0009; B67D 3/0025

See application file for complete search history.

(56) References Cited

U.S. PATENT DOCUMENTS

| | | | | |
|---|---|---|---|---|
| 6,648,187 | B1 * | 11/2003 | Shypkowski | B67D 1/0042 222/527 |
| 2004/0187516 | A1 * | 9/2004 | Lee | F25C 5/005 62/389 |
| 2005/0268639 | A1 * | 12/2005 | Hortin | B67D 1/0009 62/389 |
| 2008/0173037 | A1 * | 7/2008 | Jang | F25C 1/24 62/338 |
| 2009/0308493 | A1 * | 12/2009 | Buchstab | A47J 31/4482 141/378 |
| 2010/0175415 | A1 * | 7/2010 | Kim | F25D 23/126 62/389 |
| 2010/0319389 | A1 * | 12/2010 | Yang | F25D 23/126 62/389 |

* cited by examiner

*Primary Examiner* — Frantz Jules
*Assistant Examiner* — Erik Mendoza-Wilkenfe
(74) *Attorney, Agent, or Firm* — Dentons US LLP

(57) ABSTRACT

A refrigerator having a dispenser includes a cavity positioned on a front surface of a door of a refrigerator defining a predetermined space, a guide positioned at an upper portion of the cavity, a grip unit coupled to the guide and allowed to slide downward from the guide, and a water retrieval part provided at the grip unit.

The grip unit of the dispenser installed on the front surface of the door of the refrigerator vertically slides to allow the position of the water dispenser port to be adjusted as desired by a user.

19 Claims, 10 Drawing Sheets

REFRIGERATOR INCLUDING A DISPENSER

Pursuant to 35 U.S.C. §119(a), this application claims the benefit of the Korean Patent Application No. 10-2013-0025231, filed on Mar. 8, 2013, which is hereby incorporated by reference as if fully set forth herein.

BACKGROUND

1. Field of the Disclosure

The present disclosure relates to a refrigerator and, more particularly, to a dispenser for refrigerators that dispenses water or ice.

2. Background

In general, refrigerators can be classified into a normal refrigerator, a side-by-side type refrigerator, and a bottom freezer type refrigerator according to the structures of a freezer compartment and a fresh food compartment.

In the normal refrigerator, a freezer compartment is arranged at the upper side of the refrigerator and a fresh food compartment is disposed at the lower side of the refrigerator. In the side-by-side type refrigerator, the freezer compartment and the fresh food compartment are laterally disposed adjacent to each other.

In the bottom freezer type refrigerator, which is recently in wide use in the US and Europe, a fresh food compartment larger than a freezer compartment is arranged at the upper side and the freezer compartment is arranged at the lower side.

The freezer compartment or fresh food compartment is opened and closed by a plurality of doors installed thereon.

To increase spatial efficiency and to facilitate a user's access compared to the case in which a dispenser to dispense water or ice is provided in a separate space at the exterior of a refrigerator, a dispenser is installed at the fresh food compartment door or freezer compartment door.

In conventional cases, a water dispense port for dispensing water is fixed to the upper surface of the dispenser. Accordingly, when water is supplied into a container seated at a lower position in the dispenser, the water may splash out of the container.

In addition, to prevent water from splashing out of the container, the container may need to be held by hand and positioned near the water dispense port until dispensing of water is completed.

Further, in conventional cases, the water dispense port and an ice discharge port for dispensing ice are laterally arranged. Thereby, the inner space of the dispenser may not be sufficient for a container occupying a wide area to be stably seated in the dispenser, and the limitation of the inner space may make it difficult for the user to manipulate a switch to operate the dispenser.

Moreover, a space needed to stably seat a container during dispensing of water is not separately provided. Accordingly, in the case that the user desires a large amount of water, the user may need to hold a container by hand for a long time in order to manipulate the switch.

SUMMARY

Accordingly, the present disclosure is directed to refrigerators including a dispenser that substantially obviates one or more problems due to limitations and disadvantages described above.

One object is to provide a dispenser for refrigerators which allows water to be supplied at a desired position such that water does not splash out of a container.

Another object is to provide a dispenser for refrigerators which allows a container to be stably positioned and a switch to be stably manipulated.

Another object is to provide a dispenser for refrigerators which allows a container occupying a wide area to be stably seated during dispensing of water without requiring a user to inconveniently keep holding the container.

Additional advantages, objects, and features will be set forth in part in the description which follows and in part will become apparent to those having ordinary skill in the art upon examination of the following or may be learned from practice of the invention. The objectives and other advantages may be realized and attained by the structure particularly pointed out in the written description and claims hereof as well as the appended drawings.

To achieve these objects and other advantages and in accordance with the purpose of the invention, as embodied and broadly described herein, a refrigerator including a dispenser includes a cavity positioned on a door of a refrigerator defining a predetermined space, a guide positioned at an upper portion of the cavity, a grip unit coupled to the guide and vertically slidable with respect to the guide, and a water retrieval part provided at the grip unit.

In another aspect, a refrigerator including a dispenser includes a cavity positioned on a door of a refrigerator defining a predetermined space, a guide positioned at an upper portion of the cavity, a grip unit coupled to the guide and allowed to slide downward from the guide, a water retrieval part provided at the grip unit, and an ice retrieval part positioned on an upper surface of the cavity to allow ice to be dispensed therethrough, wherein the ice retrieval part is positioned at a rear side of the water dispense port.

In another aspect, a refrigerator including a dispenser includes a cavity positioned on a door of a refrigerator defining a predetermined space, a guide positioned at an upper portion of the cavity, a grip unit coupled to the guide and allowed to slide downward from the guide, a water retrieval part provided at the grip unit, and a container supporter provided at a surface of the cavity facing the door, wherein a shaft is provided to opposite ends of the container supporter to allow the container supporter to rotate forward from the door.

It is to be understood that both the foregoing general description and the following detailed description are exemplary and explanatory and are intended to provide further explanation of the disclosure.

BRIEF DESCRIPTION OF THE DRAWINGS

The accompanying drawings, which are included to provide a further understanding of the disclosure and are incorporated in and constitute a part of this application, illustrate embodiment(s) of the invention and together with the description serve to explain the principle of the invention. In the drawings.

DETAILED DESCRIPTION OF THE PREFERRED EMBODIMENTS

Reference will now be made in detail to the preferred embodiments of the present invention, examples of which are illustrated in the accompanying drawings. Wherever possible, the same reference numbers may be used throughout the drawings to refer to the same or like parts.

It will be appreciated that for simplicity and clarity of illustration, the dimensions or shapes of some of the elements may be exaggerated. In addition, the terms specifically defined in consideration of the configuration and operation of the embodiments of the present invention may be replaced by other terms based on intensions of the user or operator, customs, or the like. The terms used herein should be construed based on the whole content of this specification.

Figure 1:
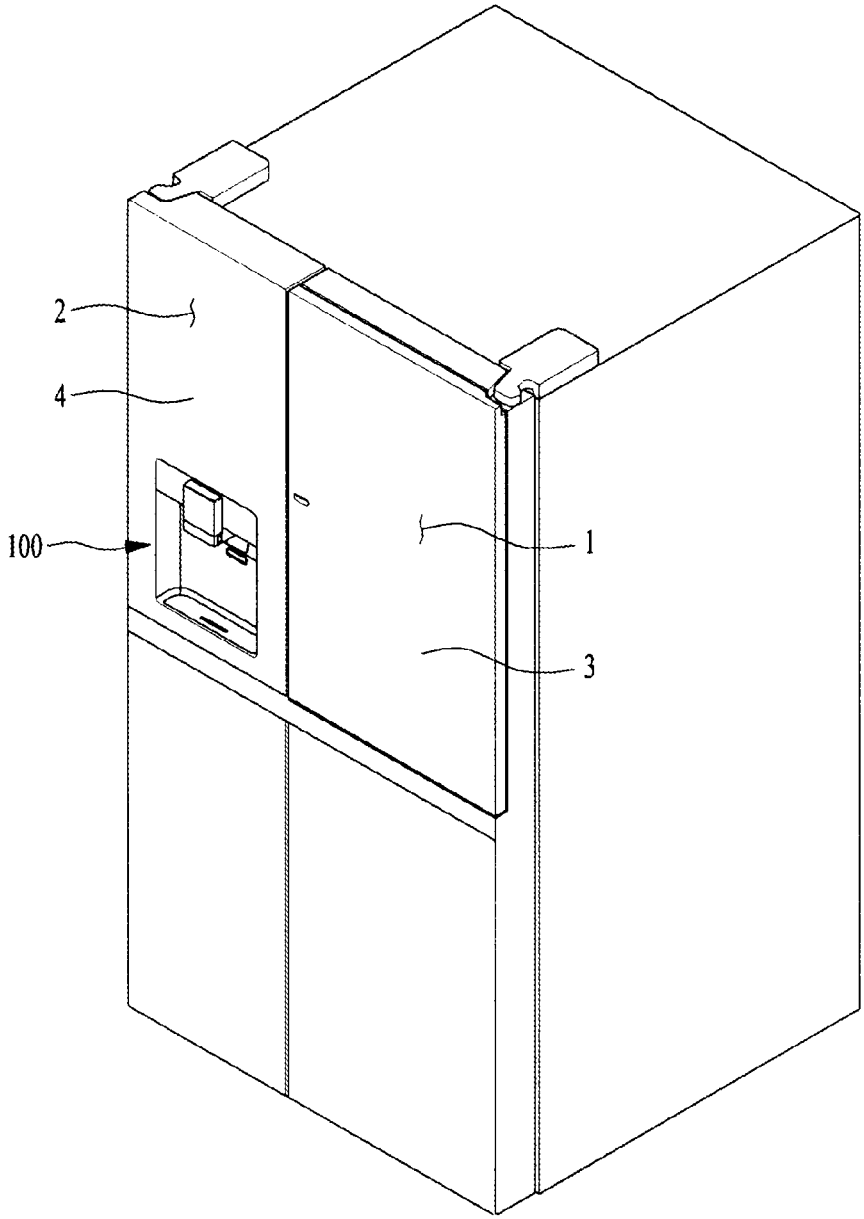
FIG. 1 is a view illustrating a side-by-side type refrigerator equipped with a dispenser for refrigerators according to an exemplary embodiment of the present invention.

FIG. 1 is a perspective view illustrating a refrigerator equipped with a dispenser 100 for refrigerators according to an exemplary embodiment of the present invention. For ease of illustration, the refrigerator will be assumed to be a side-by-side type refrigerator in this embodiment. It will be appreciated that embodiments of the present invention are not limited to this type of storage compartments.

The refrigerator according to this embodiment is generally divided into two spaces on the left and right sides. Thereby, one space defines a freezer compartment 1 where food is kept frozen, and the other space defines a fresh food compartment 2 where food is kept cooled. The refrigerator is provided with a plurality of refrigerator doors 3 and 4 to open and close the freezer compartment and the fresh food compartment. The refrigerator doors 3 and 4 may be respectively installed as a freezer compartment door 3 and a fresh food compartment door 4.

While the dispenser 100 is illustrated in FIG. 1 as being arranged on the front surface of the fresh food compartment door 4, the dispenser 100 may also be provided at the freezer compartment door 3.

Hereinafter, a description will be described of a case in which the dispenser 100 is provided to the fresh food compartment door 4.

FIGS. 2 to 7 are views illustrating the dispenser 100 in the refrigerator of FIG. 1.

The dispenser 100 for the refrigerator includes a cavity 5 positioned on the front surface of the fresh food compartment door 4 and defining a predetermined space allowing water supply, and a guide 6 positioned at the upper portion of the cavity 5 and protruding from the fresh food compartment door 4.

A water dispense port 710 is installed on a lower surface of the guide 6. The guide 6 includes a grip unit 7 which is slidable downward from the guide 6, and a water retrieval part 700 installed in the grip unit 7 and connected to the water dispense port 710.

Figure 2:
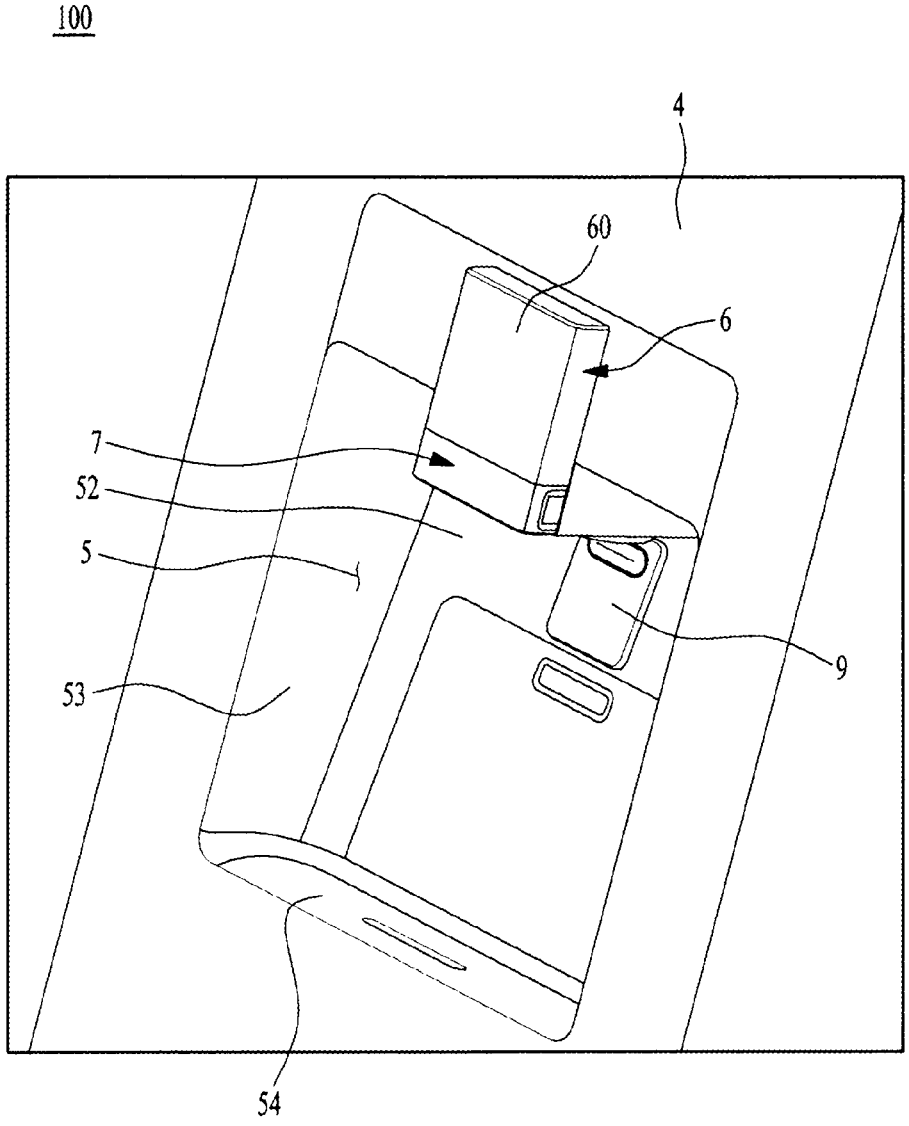
FIG. 2 is a front perspective view illustrating a dispenser for refrigerators according to one embodiment of the present invention.
Figure 3:
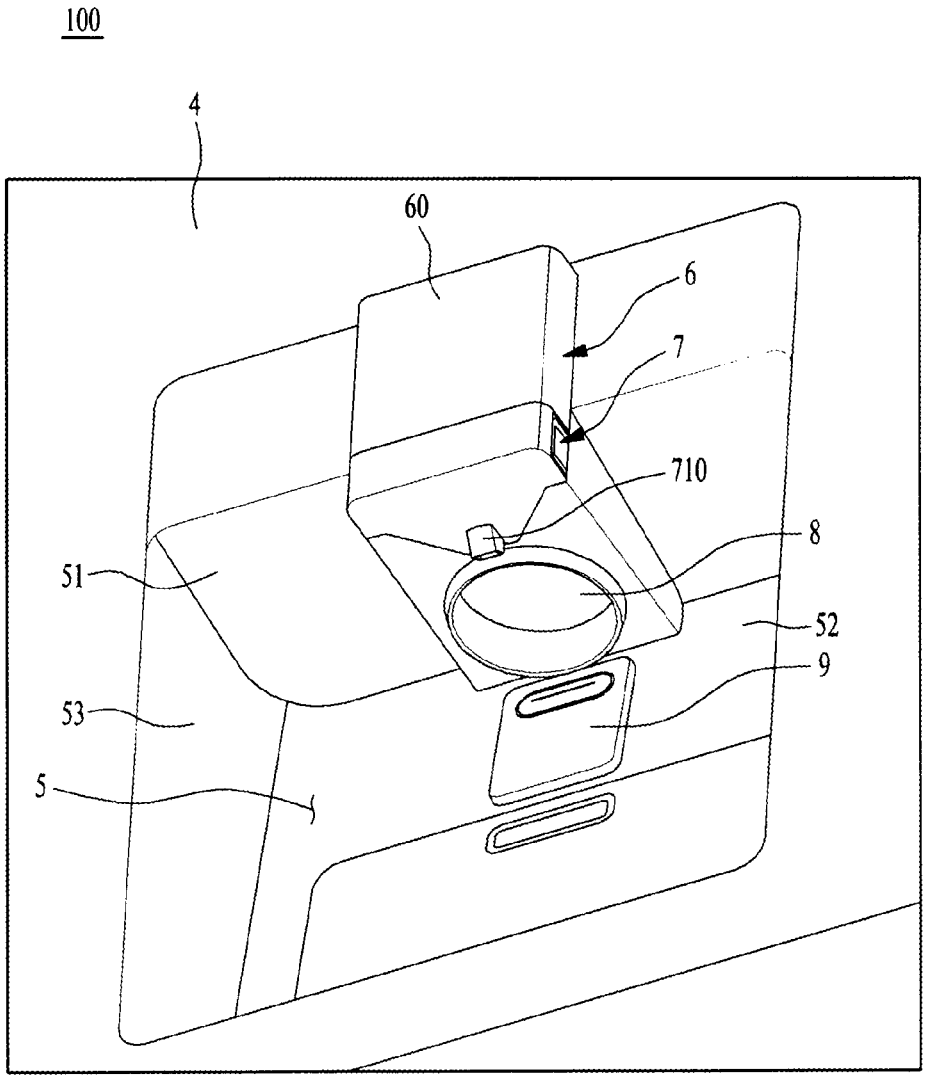
FIG. 3 is a bottom perspective view illustrating the dispenser for refrigerators.

As shown in FIG. 2 or 3, the cavity 5 with a predetermined space is provided in the front surface of the fresh food compartment door 4. The cavity 5, which is a space defined to provide water or ice through the dispenser 100, may define a hexahedral space.

The cavity 5 may be formed as a space surrounded by an upper surface 51 having a portion through which water or ice is dispensed, a rear surface 52 provided with a switch, which will be described later, left and right side surfaces 53, and a lower surface 54 and provided with an open front on the front surface of the door.

An ice retrieval part 8 through which ice is dispensed may be installed on the upper surface 51 of the cavity as shown in FIG. 3. The ice retrieval part 8 is formed in a circular shape. However, embodiments of the present invention are not limited thereto.

The ice retrieval part 8 may be installed at the rear portion of the upper surface 51 of the cavity. That is, the water dispense port 710 through which water is dispensed may be arranged in front of the ice retrieval part 8, and the ice retrieval part 8 through which ice is dispensed may be arranged at the back of the water dispense port 710.

Arranging the ice retrieval part 8 and the water dispense port 710 in series (back and front) increases the area of the left and right side surfaces 53 of the cavity 5.

That is, this arrangement causes the cavity 5 to extend deep into the fresh food compartment door 4, and accordingly increases the volume of the cavity 5, compared to a case in which the ice retrieval part 8 and the water dispense port 710 are arranged side by side.

Therefore, when ice or water needs to be supplied to a container occupying a wide area, the water dispense port 710 or the ice retrieval part 8 may be more stably positioned in the middle of the container, and the container may be positioned deeper into the cavity 5 than in the case that the ice retrieval part 8 and the water dispense port 710 are arranged side by side.

That is, when the user desires to fill a container occupying a wide area with water or ice, the container may be positioned in the cavity 5 without being restricted by the volume of the cavity 5 and the dispenser 100 may be stably used.

Accordingly, the ice retrieval part 8 is preferably positioned farther to the rear portion of the upper surface 51 of the cavity than the water dispense port 710, as shown in FIG. 3.

Figure 4:
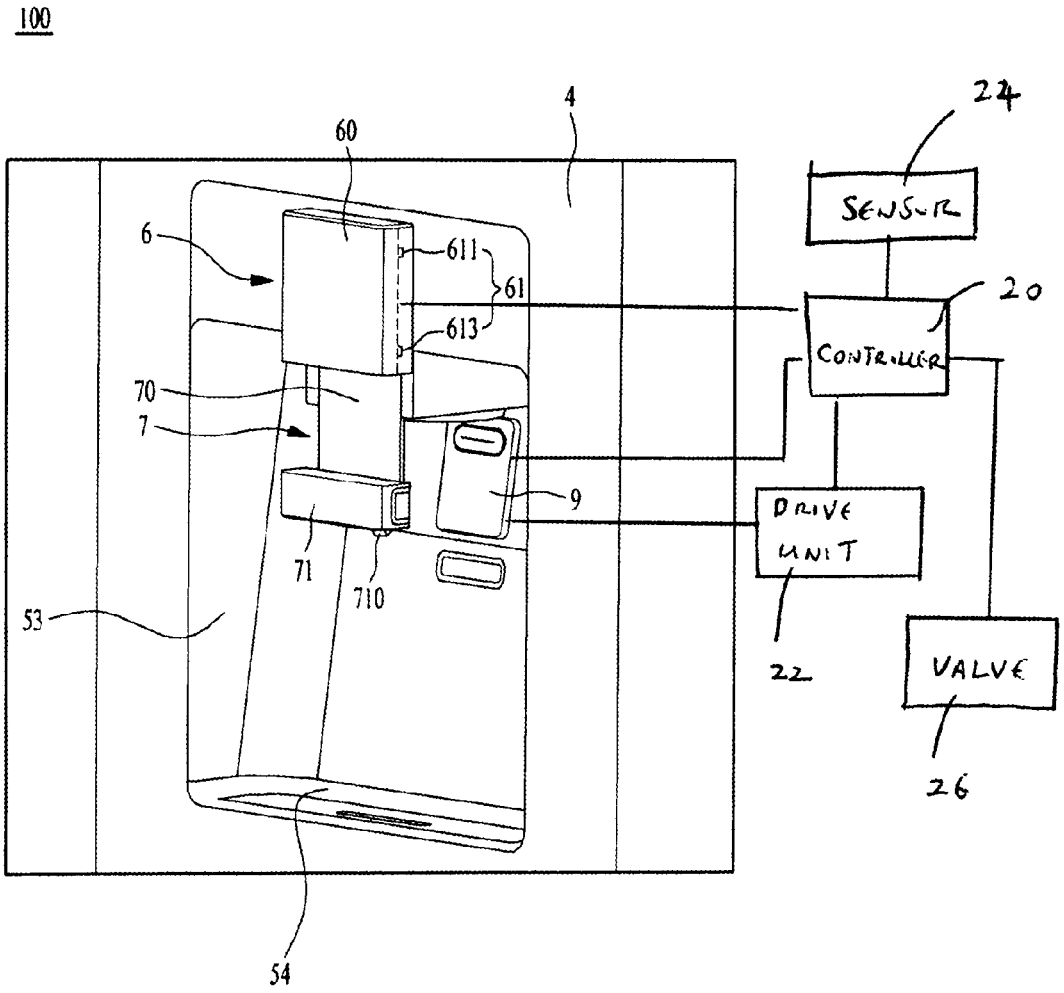
FIG. 4 is a view illustrating the dispenser for refrigerators, in which a grip is lowered.

Referring to FIG. 4, a switch 9 may be installed on the rear surface 52 of the cavity 5. The switch 9, which is manipulated by a user to dispense water or ice through the water dispense port 710 or the ice retrieval part 8, may take any form.

In this embodiment, a button type switch is provided as the switch 9. Accordingly, when the user presses the switch 9 with the container, water is dispensed through the water dispense port 710, or ice is dispensed through the ice retrieval part 8.

Hereinafter, it will be assumed that the switch 9 is a button type switch, for ease of illustration.

The dispenser 100 may be provided with a drive unit 22 which is operatively connected to the switch 9 to dispense water or ice when the switch 9 is pressed.

In addition, when the user presses the switch 9 with a container and thereby operates the drive unit 22 operatively connected to the switch 9, water is dispensed. At this time, a water conduit (not shown) may be provided in the dispenser 100 to allow water to be dispensed toward the water dispense port 710 therethrough.

When the user separates the container from the switch 9, the drive unit 22 stops operating in connection with the separation, and dispensing of water or ice is stopped.

The guide 6 may be installed at the upper portion of the cavity 5 and may protrude from the fresh food compartment door 4.

When the guide 6 protrudes, the grip unit 7 coupled to the guide 6 is positioned at the front of the cavity 5 rather than in the cavity 5.

Thereby, the grip unit 7 is positioned at the exterior of the cavity 5 and thus visible to the user. Accordingly, the user may advantageously reach the grip unit 7 and slide the grip unit 7 in a vertical direction without putting their hand into the cavity 5.

The guide 6 guides the grip unit 7 such that the grip unit 7 vertically slides without escaping from the path set by the guide 6.

A display unit 60 is formed on the front surface of the guide 6. The display unit 60 may display the status of the dispenser 100 and allow the user to input a desired command for setting therethrough.

The display unit 60 may be provided with buttons or light emitting diodes (LEDs) to allow input of information through touch. Alternatively, the display unit 60 may be provided with different elements allowing for input of information. However, embodiments of the present invention are not limited thereto.

The position of the water dispense port 710 installed on the lower surface of the grip unit 7 is changed by vertical sliding of the grip unit 7.

Use of the dispenser 100 according to the position of the water dispense port 710 is disclosed below.

First, in the case that the grip unit 7 is lifted and coupled to the lower portion of the guide 6, water or ice may be dispensed when the user presses the switch 9 with a container.

The user is preferably allowed to input a command through the display unit 60 to select dispensing of water or ice before the user presses the switch 9 with the container. When a command to dispense water is inputted through the display unit 60 and then the switch 9 is pressed with the container, water is dispensed through the water dispense port 710. When a command to dispense ice is inputted and then the switch 9 is pressed with the container, ice is dispensed through the ice retrieval part 8.

In the case that dispensing of water or ice is not selected with the grip unit 7 lifted, it is preferable that the dispenser 100 does not operate even if the switch 9 is pressed.

This is intended to prevent water or ice from being unintentionally dispensed when the switch 9 is pressed with the grip unit 7 lifted.

In the case that a short container is used, the grip unit 7 is lowered below the guide 6 and thus the water dispense port 710 is positioned away from the guide 6 as shown in FIG. 4, in order to prevent water from splashing out of the container.

In this case, the user may use the dispenser 100, while placing the container on the lower surface 54 of the cavity.

At this time, it may be inconvenient to continually press the switch 9 with the container to dispense water when the user wants a large amount of water to be dispensed.

In addition, in the case that the grip unit 7 is lowered, the user may feel inconvenienced in manipulating the switch 9.

Accordingly, when the grip unit 7 is lowered, it is preferable that ice, a small amount of which is usually required, is dispensed through manipulation of the switch 9 and that water is dispensed through the water dispense port 710 by inputting information through the display unit 60.

That is, the user may set information about water amount or water dispensing time through the display unit 60 to dispense water. When the user sets and input the water amount or water dispensing time, the drive unit operates to dispense water by the set amount or for the set time.

In the case that the user sets and inputs a water amount, dispensing of water needs to be stopped after water is dispensed by the amount set by the user. Accordingly, the dispenser 100 may be provided with a water amount sensor 24 to sense the amount of dispensed water.

When it is sensed by the water amount sensor 24 that water has been dispensed by the set amount, dispensing of water should be stopped. Accordingly, a valve 26 is preferably provided to the water conduit to regulate dispensing of water.

This is also applied to the case in which the water dispensing time is set. Once a set time elapses, dispensing of water is regulated by the valve 26.

The dispenser 100 may further include a controller 20 for controlling of the valve 26. The controller 20 may control not only the valve 26 but also the drive unit 22.

In the case that the grip unit 7 is lowered and the water dispense port 710 stays far apart from the guide 6, when information is inputted through the display unit 60 by the user, the inputted information is transmitted to the controller, the controller 20 in turn controls the drive unit 22 to dispense water.

In addition, when it is sensed by the water amount sensor 24 that the set time has elapsed or water has been dispensed by the set amount, a signal is transmitted to the controller 20, and the controller 20 in turn controls and shuts off the valve 26. Thereby, dispensing of water through the water conduit may be stopped.

Thus, even in the case that dispensing of water is selected through the display unit 60 with the grip unit 7 lifted, a water amount or dispensing time may be set through the display unit 60 to dispense water without manipulation of the switch 9.

In the case that dispensing of a small amount of water is desired, manipulating the switch 9 may be a more convenient way of dispensing water than inputting information through the display unit 60. Accordingly, in the case that the grip unit 7 stays lifted, inputting information through the display unit 60 to dispense water may be rarely useful.

As shown in FIG. 4, a fixing part 61 to fix the grip unit 7 adapted to slidably move may be provided in the guide 6.

Two or more fixing parts 61 may be provided. Preferably, a plurality of fixing parts is provided to fix the grip unit 7 at a height desired by the user.

The fixing parts 61 may be vertically aligned in line in the guide 6, which the grip unit 7 contacts when moving.

Herein, when a fixing part positioned higher than the other aligned fixing parts 61 is defined as a first fixing part 611, and another fixing part positioned lower than the other fixing parts is defined as a second fixing part 613, the grip unit 7 is fixed between the first fixing part 611 and the second fixing part 613, which will be described in detail later.

As shown in FIG. 4, the grip unit 7 is installed so as to be vertically slidable. As the grip unit 7 vertically slides, the height of the water dispense port 710 may be adjusted as desired by the user.

Thereby, the user may not need to inconveniently hold a short container near the water dispense port 710 to receive water.

That is, in the case that a short container is placed on the lower surface of 54 of the cavity to receive water, the grip unit 7 may be slid downward to position the water dispense port 710 close to the container. Accordingly, water may be prevented from splashing out of the container.

The grip unit 7 may include a slide plate 70 inserted into the guide 6 when the grip unit 7 stays lifted, and a grip 71 arranged at the exterior of the guide 6 and coupled to the lower portion of the guide 6.

The slide plate 70 may be a thin plate inserted into the guide 6. Preferably, the slide plate 70 has the same or similar size and width as the guide 6.

In addition, when the grip unit 7 is lowered, the slide plate 70 slides vertically downward while being guided by the guide 6 and is thus withdrawn from its inserted position in the guide 6.

Figure 5:
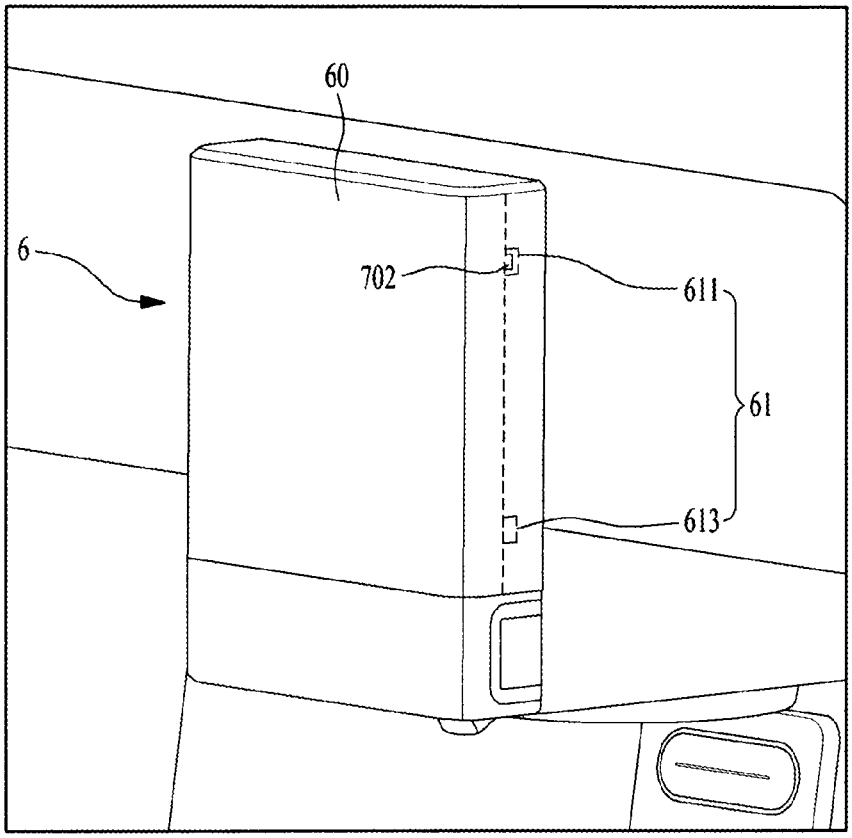
FIGS. 5 and 6 are views illustrating a slide plate fixed inside a guide with the grip lifted and lowered, respectively.
Figure 6:
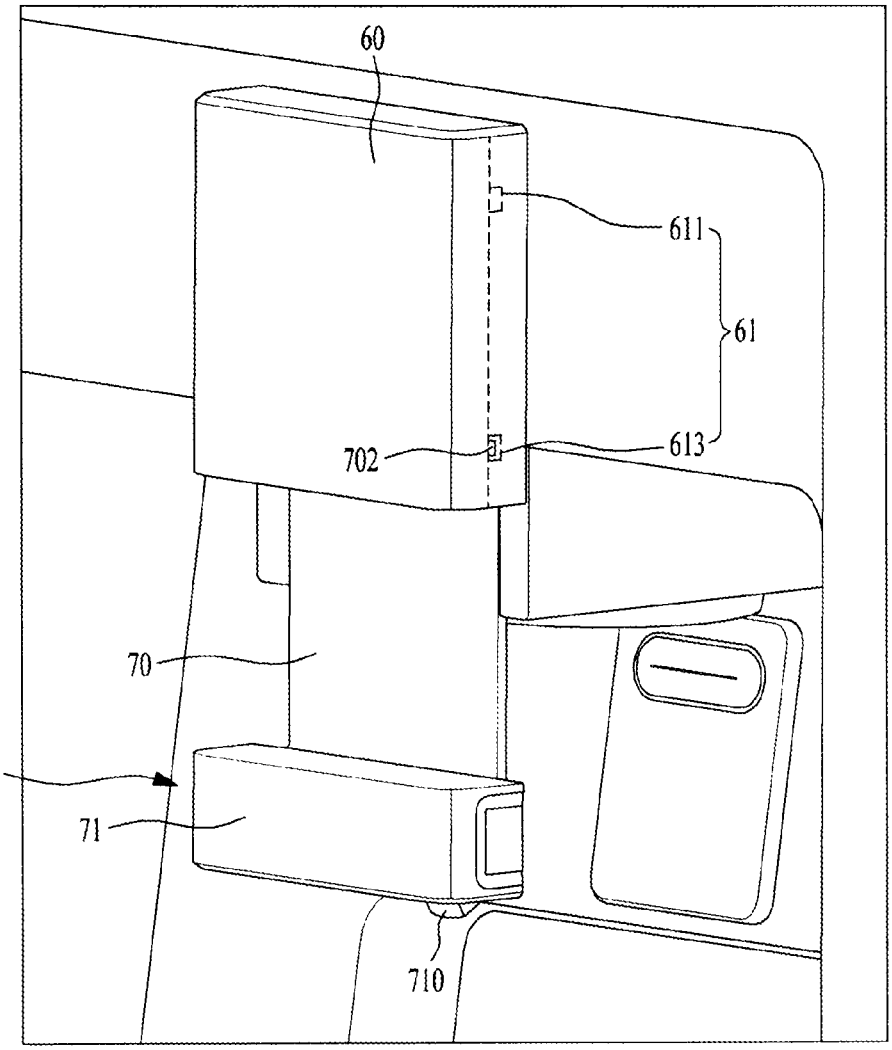

As shown in FIGS. 5 and 6, a protruding rib 702 that fixes to the fixing part 61 may be formed at the exterior of the slide plate 70 through which the slide plate 70 contacts the guide 6.

Preferably, the protruding rib 702 is installed at both ends of the slide plate 70 which slide in contact with the interior of the guide 6.

While the protruding rib 702 is exemplarily shown in FIGS. 5 and 6 as a means that is fixed by the fixing parts 61, it may be implemented in various possible forms within the art.

When the grip unit 7 is lifted, the protruding rib 702 is fixed to the first fixing part 611 installed at a higher position than any other fixing parts 61, as shown in FIG. 5. Accordingly, the grip unit 7 may be kept lifted without sliding downward.

When the grip unit 7 is slid downward and thus the slide plate 70 is drawn out as shown in FIG. 6, the protruding rib 702 is fixed to the second fixing part 613 installed at a lower position than any other fixing parts 61. Accordingly, the grip unit 7 may be kept lowered without being separated from the guide 6.

Figure 7:
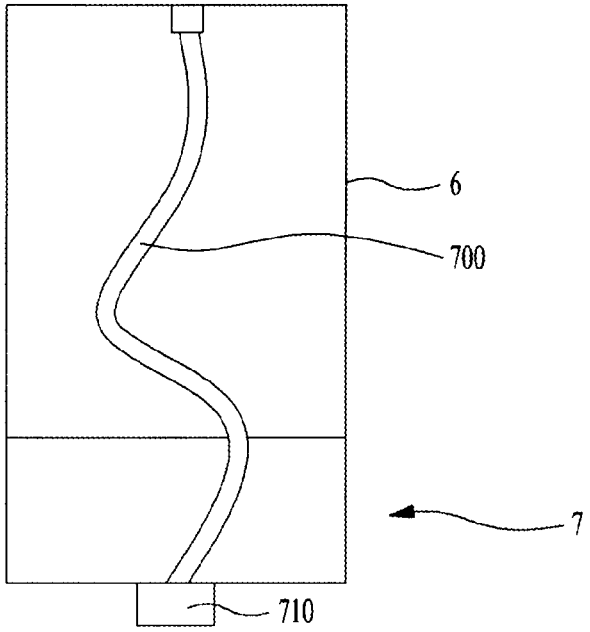
FIGS. 7 and 8 are views illustrating a water retrieval part installed in the slide plate of the grip with the grip lifted and lowered, respectively.
Figure 8:
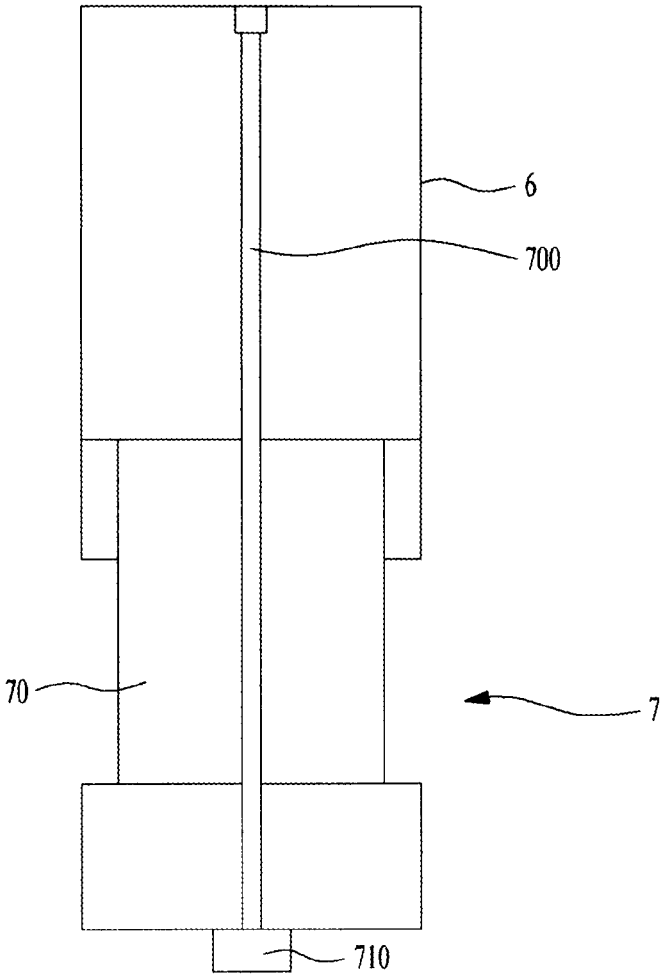

FIGS. 7 and 8 are views illustrating the water retrieval part 700 provided in the slide plate 70.

As shown in FIGS. 7 and 8, the water retrieval part 700 is provided in the slide plate 70 and serves as a water passage allowing water supplied through the water conduit to be dispensed to the water dispense port 710 therethrough.

The water retrieval part 700 may be formed in the shape of a conduit and bent within the slide plate 70 as shown in FIG. 7.

The slide plate 70 is inserted into and drawn out of the guide 6 according to vertical sliding movement of the grip unit 7. As shown in FIG. 8, the water retrieval part 700 preferably has a bent shape since it needs to serve as a water passage connected to the water dispense port 710 even when the slide plate 70 is drawn out of the guide 6.

That is, when the slide plate 70 is inserted into the guide 6, the water retrieval part 700 is bent as shown in FIG. 7. When the slide plate 70 is drawn out of the guide 6 by lowering the grip unit 7, the water retrieval part 700 is straightened out to allow water to be supplied to the water dispense port 710, as shown in FIG. 8.

The water retrieval part 700 of this embodiment is illustrated as being a bendable pipe. However, it may take the form of bellows (not shown) in another embodiment. In this case, the slide plate 70 creases when inserted into the guide 6, and stretches straight when drawn out of the guide 6.

The water retrieval part 700 may take various forms other than the embodiments illustrated in this specification.

Figure 9:
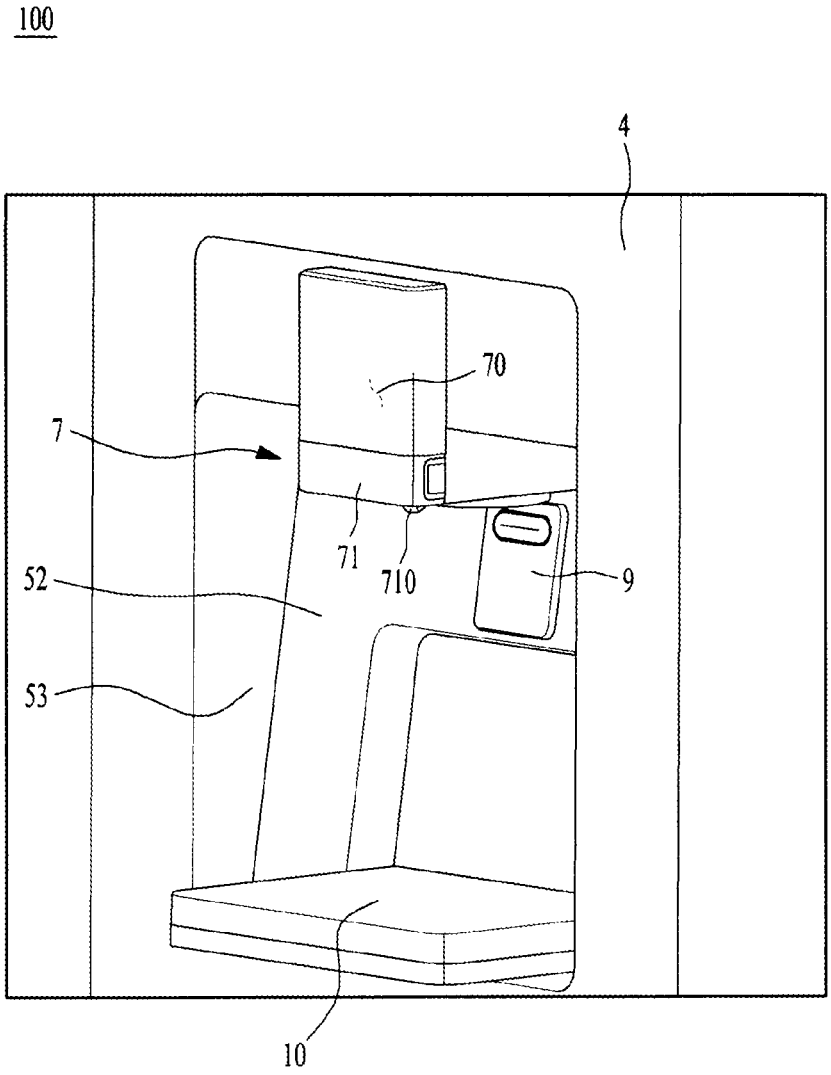
FIG. 9 is a view illustrating a container supporter stretched out by rotating forward from a door of a refrigerator.

As shown in FIG. 9, the grip 71 may be coupled to the slide plate 70 at the lower portion of the grip unit 7. The grip 71, which is reached by the user, may be installed such that the user easily slides the grip unit 7 downward by holding both sides of the grip 71.

That is, the user may slide the grip unit 7 downward by holding the grip 71 to adjust the vertical position of the water dispense port 710.

As shown in FIG. 9, the dispenser 100 may include a container supporter 10 which is embedded in the rear surface 52 of the cavity 5.

The container supporter 10 may include a shaft (not shown) arranged at both ends of a portion of the container supporter 10 close to the lower surface 54 of the cavity. Preferably, the container supporter 10 opens out by rotating forward from the fresh food compartment door 4 about the shaft.

The container supporter 10 allows the user to place a container on the container supporter 10 rather than holding the container to use the dispenser 100 to dispense water.

In addition, when the container supporter 10 is opened out from its embedded position, the area of the interior of the cavity 5 increases by the area of the container supporter 10 opened out from the embedded position. Accordingly, when a container occupying a wide area is placed the cavity 5, it is allowed to reach the space in the rear surface of 52 and the container supporter 10. Therefore, the container may be stably seated on the container supporter 10.

When the container supporter 10 is not needed, the container supporter 10 may be rotated and embedded in the rear surface 52 of the cavity 5. Thereby, a taller container may be used without interference by the container supporter 10 than when the container supporter 10 is opened out.

That is, the dispenser 100 may enhance user convenience with the container supporter 10 which is rotatable depending upon whether the user uses a tall container or a container occupying a wide area.

Preferably, the length of the container supporter 10 is only allowed to extend up to the lower edge of the switch 9 in order to prevent the container supporter 10 from interfering with the switch 9 when the container supporter 10 is rotated and embedded in the rear surface 52 of the cavity 5.

More preferably, to secure sufficient space where a container is seated, the container supporter 10 has a maximum length which does not cause interference with the switch 9.

Figure 10:
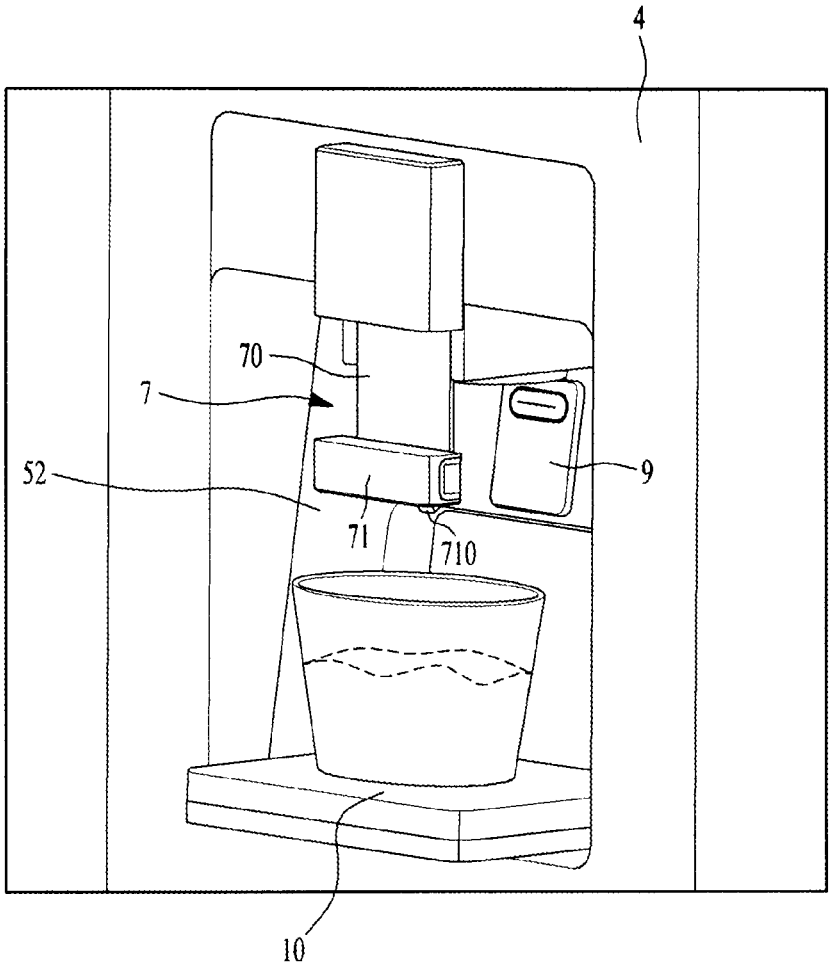
FIG. 10 is a view illustrating the container supporter stretched out by rotating forward from the door of the refrigerator, with a container seated on the container supporter and the grip lowered.

In the case that a short container occupying a wide area is used as shown in FIG. 10, the container may be stably seated on the container supporter 10 by rotating and opening the container supporter 10 forward and placing the container in the cavity such that the container reaches even the empty space in the rear surface 52 where the container supporter 10 is embedded.

In addition, to prevent water from splashing out of the short container seated on the container supporter 10 when water is dispensed, the grip unit 7 is lowered and the water dispense port 710 is positioned closed to the container, as shown in FIG. 10.

That is, in using the dispenser 100, a container occupying a wide area is seated on the container supporter 10. Thereby, the user may be released from the inconvenience of keeping to hold the container. In addition, when a short container is placed on the container supporter 10, the water dispense port 710 may be lowered to prevent water from splashing out of the container.

As is apparent from the above description, the effects are as follows.

A dispenser for refrigerators according to an embodiment of the present invention allows a grip to vertically slide such that the position of the water dispense port is adjusted for user convenience. Accordingly, when the user dispenses water, water may be prevented from splashing out of the container, and the user may not need to keep holding the container.

In addition, since a water dispense port and an ice retrieval part are disposed in series (front and back), a container may be stably positioned without being restricted by the inner space before a switch is pressed.

Moreover, a container may be stably seated on a built-in container supporter while the container supporter is opened forward and water is dispensed.

It will be apparent to those skilled in the art that various modifications and variations can be made without departing from the spirit or scope of the invention. Thus, it is intended that the claims cover the modifications and variations.

What is claimed is:

1. A refrigerator including a dispenser, comprising:

a door of the refrigerator including a cavity provided on the door, the cavity defining a predetermined space;

a guide positioned at an upper portion of the cavity and protruding from the door;

a grip unit coupled to the guide and vertically slidable with respect to the guide; and a water retrieval part provided at the grip unit, wherein the grip unit comprises:

a slide plate inserted into the guide; and a grip coupled to the slide plate and arranged outside of the guide, wherein the slide plate is drawn out of the guide when the grip is lowered away from the guide, further comprising a water dispense port positioned on a lower surface of the grip and coupled to the water retrieval part to allow water to be dispensed therethrough.

2. The refrigerator according to claim 1, further comprising an ice retrieval part positioned on an upper surface of the cavity to allow ice to be dispensed therethrough.

3. The refrigerator according to claim 2, wherein the ice retrieval part is positioned at a rear side of the water dispense port.

4. The refrigerator according to claim 2, further comprising:

a switch arranged on a rear surface of the cavity; and a drive unit operatively connected to the switch to dispense water or ice.

5. The refrigerator according to claim 4, wherein, when the switch is activated with the grip unit lifted towards the guide, water or ice is dispensed by the drive unit.

6. The refrigerator according to claim 4, further comprising a display unit arranged on a front surface of the guide, wherein the display unit is provided with an input unit to allow a user to input a command therethrough.

7. The refrigerator according to claim 6, wherein, when the grip unit is lifted towards the guide, the user is allowed to input information through the display unit to select dispensing of water or dispensing of ice.

8. The refrigerator according to claim 6, wherein, when the grip unit is lowered away from the guide, the user is allowed to input information about a water amount or time through the display unit to dispense water.

9. The refrigerator according to claim 8, further comprising:

a water amount sensor to sense an amount of dispensed water; and a valve unit to regulate dispensing of water.

10. The refrigerator according to claim 9, further comprising a controller to control the drive unit and the valve unit.

11. The refrigerator according to claim 10, wherein, when the time set through the display unit elapses, the valve unit is shut off by the controller.

12. The refrigerator according to claim 4, further comprising a container supporter provided at the rear surface of the cavity of the door, wherein a shaft is provided to opposite ends of the container supporter to allow the container supporter to rotate forward from the door.

13. The refrigerator according to claim 12, wherein a length of the container supporter extends up to a lower edge of the switch.

14. The refrigerator according to claim 1, wherein the water retrieval part is arranged bent in the slide plate and is straightened when the grip unit is lowered.

15. The refrigerator according to claim 1, further comprising:

At least one fixing part provided in the guide; and a protruding rib provided to the slide plate and fixes to the fixing part.

16. The refrigerator according to claim 15, wherein the at least one fixing part comprises two or more fixing parts, wherein the two or more fixing parts are vertically aligned in a line.

17. The refrigerator according to claim 16, wherein a first fixing part of the fixing parts is positioned higher than the other fixing parts and fixes the slide plate inserted into the guide to prevent the slide plate from being lowered from the guide.

18. The refrigerator according to claim 16, wherein a second fixing part of the fixing parts is positioned lower than the other fixing parts and fixes the grip unit lowered and fully drawn out of the guide in order to prevent the grip unit from being removed from the guide.

19. A refrigerator including a dispenser, comprising:

a door of the refrigerator including a cavity provided on the door, the cavity defining a predetermined space;

a guide positioned at an upper portion of the cavity and protruding from the door;

a grip unit coupled to the guide and allowed to slide downward from the guide;

a water retrieval part provided to the grip unit; and a container supporter provided at a rear surface of the cavity, wherein a shaft is provided to opposite ends of the container supporter to allow the container supporter to rotate forward from the door, wherein the grip unit comprises:

a slide plate inserted into the guide; and a grip coupled to the slide plate and arranged outside of the guide, wherein the slide plate is drawn out of the guide when the grip unit is lowered away from the guide, further comprising a water dispense port positioned on a lower surface of the grip and coupled to the water retrieval part to allow water to be dispensed therethrough.

* * * * *